US007482749B2

(12) United States Patent
Ahn

(10) Patent No.: US 7,482,749 B2
(45) Date of Patent: Jan. 27, 2009

(54) GAS DISCHARGE APPARATUS AND PLASMA DISPLAY PANEL

(75) Inventor: Sung Yong Ahn, Gyeongsangbuk-do (KR)

(73) Assignee: LG. Electronics Inc., Seoul (KR)

( * ) Notice: Subject to any disclaimer, the term of this patent is extended or adjusted under 35 U.S.C. 154(b) by 522 days.

(21) Appl. No.: 11/166,112

(22) Filed: Jun. 27, 2005

(65) Prior Publication Data

US 2006/0091801 A1 May 4, 2006

(30) Foreign Application Priority Data

Oct. 29, 2004 (KR) ..... 10-2004-0087528
Dec. 23, 2004 (KR) ..... 10-2004-0111509

(51) Int. Cl.
*H01J 17/49* (2006.01)

(52) U.S. Cl. ..... 313/582; 313/230

(58) Field of Classification Search ..... 313/582, 313/230, 359.1
See application file for complete search history.

(56) References Cited

FOREIGN PATENT DOCUMENTS

| | | |
|---|---|---|
| JP | 07-085798 | 3/1995 |
| JP | 09-092161 | 4/1997 |
| JP | 2000-067763 | 3/2000 |
| JP | 2000-294145 | 10/2000 |
| JP | 2003-043987 | 2/2003 |
| JP | 2005-285481 | 10/2005 |
| KR | 10-2001-0093283 | 10/2001 |
| KR | 10-2004-0072370 | 8/2004 |

*Primary Examiner*—Vip Patel
(74) *Attorney, Agent, or Firm*—McKenna Long & Aldridge LLP

(57) ABSTRACT

There is disclosed a gas discharge apparatus that is adaptive for reducing a discharge voltage as well as increasing its brightness and luminescence efficiency.

In a gas discharge apparatus according to an embodiment of the present invention, a discharge gas injected into the discharge space includes a hydrogen group isotope gas in a mixture ratio of 0.01%~2.0%.

24 Claims, 10 Drawing Sheets

GAS DISCHARGE APPARATUS AND PLASMA DISPLAY PANEL

This application claims the benefit of the Korean Patent Application Nos. P2004-87528 and P2004-111509 filed on Oct. 29, 2004, and on Dec. 23, 2004 which are hereby incorporated by reference.

BACKGROUND OF THE INVENTION

1. Field of the Invention

The present invention relates to a gas discharge apparatus, and more particularly to a gas discharge apparatus and a plasma display panel that is adaptive for reducing a discharge voltage as well as increasing its brightness and luminescence efficiency.

2. Description of the Related Art

Generally, a gas discharge apparatus is made in a tube or panel shape to be used as a lighting light source. Recently, a plasma display panel (hereinafter, referred to as "PDP"), which displays a picture by use of gas discharge principle, is put on the market.

The PDP has attracted attention as a large sized flat panel display, and it makes a phosphorus emit light by an ultraviolet ray of 147 nm which is generated upon the discharging of an inert mixture gas (or discharge gas) such as He+Xe, He+Ne+Xe or Ne+Xe, thereby displaying a picture including characters and graphics. Such a PDP is easy to be made into a thin-film and large-dimension type. Moreover, the PDP provides a very improved picture quality owing to a recent technical development. Particularly, a three electrode AC surface discharge PDP has advantages of a low voltage driving and a long life span in that it can lower a voltage required for a discharge using wall charges accumulated on the surface thereof during the discharge and protect the electrodes from a sputtering generated by the discharge.

FIG. 1 is a diagram representing a discharge cell of a related art three electrode AC surface discharge PDP.

Referring to FIG. 1, a discharge cell of the three electrode AC surface discharge PDP includes a scan electrode Y and a sustain electrode Z formed on an upper substrate 10, and an address electrode X formed on a lower substrate 18. Each of the scan electrode Y and the sustain electrode Z includes transparent electrodes 12Y, 12Z and metal bus electrodes 13Y, 13Z of which each has a narrower line width than the transparent electrode and is formed at one side edge of the transparent electrode.

The transparent electrodes 12Y, 12Z are formed of indium tin oxide ITO on the upper substrate 10 in the related art. The metal bus electrodes 13Y, 13Z are formed of a metal such as chrome Cr on the transparent electrodes 12Y; 12Z to act to reduce a voltage drop which is caused by the transparent electrodes 12Y, 12Z of high resistance. A dielectric layer 14 and a passivation film 16 are deposited on the upper substrate 10 where the scan electrode Y and the sustain electrode Z are formed in parallel. A wall charge generated upon a plasma discharge is accumulated in an upper dielectric layer 14. The passivation film 16 prevents the loss of the upper dielectric layer 14 from the sputtering caused by ions generated upon the plasma discharge and increases the emission efficiency of secondary electrons. The passivation film 16 is of magnesium oxide MgO in the related art.

A lower dielectric layer 22 is formed on the lower substrate 18 where the address electrode X is formed, and a phosphorus layer 26 is spread over the surface of barrier ribs 24 and the lower dielectric layer 22. The address electrode X is formed in a direction that it crosses the scan electrode Y and the sustain electrode Z. The barrier ribs 24 are formed in a stripe or lattice shape to prevent an ultraviolet ray and a visible ray, which are generated by the discharge, from leaking into adjacent discharge cells. The phosphorus layer 26 is excited by the ultraviolet ray, which is generated upon the plasma discharge, to generate any one of red, green and blue visible rays. An inert mixture gas is injected into a discharge space provided between the upper/lower substrate 10, 18 and the barrier ribs 24.

In order to realize the gray level of a picture, the PDP is time-dividedly driven by dividing one frame into several sub-fields that have the number of their light emissions different from one another. Each sub field can be divided into a reset period to initialize a full screen, an address period to select scan lines and select cells from the selected scan lines, and a sustain period to realize gray levels in accordance with the number of discharges.

Herein, the reset period is divided into a setup period when a rising ramp waveform is supplied and a setdown period when a falling ramp waveform is supplied. For example, in the event of displaying a picture with 256 gray levels; the frame period (16.67 ms) corresponding to 1/60 second as in FIG. 2 is divided into 8 sub-fields (SF1 to SF8). Each of the 8 sub-fields (SF1 to SF8), as described above, is divided into the reset period, the address period and the sustain period. The reset period and the address period of each sub-field are the same for each sub-field, while the sustain period increases at the rate of $2^n$ (n=0,1,2,3,4,5,6,7) in each sub-field.

FIG. 3 is a waveform representing a driving method of a related art PDP.

Referring to FIG. 3, the related art PDP is divided into the reset period to initialize the whole screen, the address period to select the cell and the sustain period to keep the discharge of the selected cell, to be driven.

In the reset period, a rising ramp waveform Ramp-up that rises to a peak voltage Vp is simultaneously applied to all the scan electrodes Y in a the setup period. The rising ramp waveform Ramp-up causes a weak discharge to be generated within the cellw of the whole screen, thereby generating wall charges within the cells. The rising ramp waveform Ramp-up like this remains at the peak voltage Vp for a designated time after rising to the peak voltage Vp.

In the setdown period, a falling ramp waveform Ramp-down that falls from a positive voltage, which is lower than the peak voltage Vp, to a negative voltage −Vr is simultaneously applied to the scan electrodes Y. The falling ramp wave form Ramp-down causes a weak erasure discharge to be generated within the cells, thus eliminating unnecessary charges among the space charges and the wall charges generated by the setup discharge and causing the necessary wall charges to remain behind uniformly, wherein the necessary wall charges are required for the address discharge within the cells of the whole screen.

In the address period, a negative scan pulse Scan is sequentially applied to the scan electrodes Y, and at the same time, a positive data pulse Data is applied to the address electrodes X. The voltage difference of the data pulse Data from the scan pulse Scan is added to the wall voltage which is generated during the reset period, to generate an address discharge within the cell to which the data pulse Data is applied. The address discharge causes the wall charges generated within the selected cells, wherein the wall charges are necessary for the cell discharge of the sustain period.

On the other hand, a positive DC voltage of sustain voltage level Vs is supplied to the sustain electrodes Z during the setdown period and the address period.

In the sustain period, the sustain pulse Vs is alternately applied to the scan electrodes Y and the sustain electrodes Z. Then, in the cell selected by the address discharge, the sustain discharge is generated in a surface discharge form between the scan electrode Y and the sustain electrode Y whenever the sustain pulse Vs is applied as the wall voltage within the cell is added to the sustain pulse Vs. Lastly, after completion of the sustain discharge, an erasure ramp waveform Erase with small pulse width is supplied t the sustain electrode Z to erase the wall charges within the cell.

On the other hand, in the related art, there is proposed a method of increasing the brightness by increasing the mixture ratio of Xe in the discharge gas, which is sealed within the PDP, to 4%~6%. To describe this more specifically, in case of a conventional PDP which is used commercially, it has an efficiency of about 1.0~1.2 lm/W on the basis of the PDP module. However, in the PDP, if the Xe ratio is increased to 4~6%, it has an efficiency of not more than about 1.5 lm/W. Accordingly, it is possible to display an image having higher brightness and luminescence efficiency in the PDP where Xe of 4%~6% is included in the discharge gas than a low density Xe PDP.

As another method for improving the brightness and the luminescence efficiency, there is proposed a long gap PDP method that the distance between the scan electrode Y and the sustain electrode Z formed on the upper substrate is made to be long in a 60~80 μm level.

However, the high density Xe PDP or the long gap PDP has disadvantage that a discharge firing voltage or a discharge voltage becomes higher in comparison with the low density Xe or show gap PDP. In other words, if Xe of high density is injected into the PDP or the gap between the upper plate electrodes is broadened, then the discharge generation probability becomes low by the Xe component or the gap between the electrodes. Accordingly, in order to generate the discharge stably, a discharge voltage having high voltage value has to be applied. Further, in the high density Xe PDP or the long gap PDP, the discharge voltage where the discharge starts becomes higher, thus there is a problem that power is consumed as high as that. Because high power consumption is required like this, in order to drive the high density Xe PDP or the long gap PDP smoothly, it is required to use expensive drive circuit devices, thus there are problems that the manufacturing cost increases and the reactive power increases due to high power consumption.

SUMMARY OF THE INVENTION

Accordingly, it is an object of the present invention to provide a gas discharge apparatus and a plasma display panel that is adaptive for reducing a discharge firing voltage.

It is another object of the present invention to provide a gas discharge apparatus and a plasma display panel that is adaptive for reducing a discharge voltage as well as increasing its brightness and luminescence efficiency in a long gap PDP or a high density Xe PDP.

In order to achieve these and other objects of the invention, a gas discharge apparatus according to an aspect of the present invention includes a hydrogen group isotope gas in a mixture ratio of 0.01%~2.0%.

In the gas discharge apparatus, the hydrogen group isotope gas includes at least one hydrogen group isotope gas of $H_2$, $D_2$ and $T_2$.

In the gas discharge apparatus, the discharge gas includes at least two hydrogen group isotope gas of $H_2$, $D_2$ and $T_2$.

A gas discharge apparatus according to another aspect of the present invention includes at least one hydrogen group isotope gas of $H_2$ and $T_2$.

In the gas discharge apparatus, the hydrogen group isotope gas is included in the discharge gas in a mixture ratio of 0.01%~2.0%.

A plasma display panel according to still another aspect of the present invention includes: a first substrate having at least one electrode; a second substrate having at least one electrode; and a discharge gas charged in a discharge space between the first and second substrates, and wherein the discharge gas includes a hydrogen group isotope gas in a mixture ratio of 0.01%~2.0%.

In the plasma display panel, the hydrogen group isotope gas includes: at least one hydrogen group isotope gas of $H_2$, $D_2$ and $T_2$.

A plasma display panel according to still another aspect of the present invention includes: a first substrate having at least one electrode; a second substrate having at least one electrode; and a discharge gas charged in a discharge space between the first and second substrates, and wherein the discharge gas includes at least one hydrogen group isotope gas of $H_2$ and $T_2$.

In the plasma display panel, the hydrogen group isotope gas is included in the discharge gas in a mixture ratio of 0.01%~2.0%.

A plasma display panel according to still another aspect of the present invention includes: a first substrate having at least one electrode; a second substrate having at least one electrode; and a discharge gas charged in a discharge space between the first and second substrates, and wherein the discharge gas includes a hydrogen group isotope gas in a mixture ratio of 0.01%~2.0%, and a gap between the electrodes formed on the first substrate is between 80 μm and 500 μm.

In the plasma display panel, the electrodes separated with the gap between 80 μm and 500 μm are a scan electrode and a sustain electrode.

In the plasma display panel, the hydrogen group isotope gas includes: at least one hydrogen group isotope gas of $H_2$, $D_2$ and $T_2$.

In the plasma display panel, the gap between the scan electrode and the sustain electrode is between 100 μm and 200 μm.

A plasma display panel according to still another aspect of the present invention includes: a first substrate having at least one electrode; a second substrate having at least one electrode; and a discharge gas charged in a discharge space between the first and second substrates, and wherein the discharge gas includes a hydrogen group isotope gas in a mixture ratio of 0.01%~2.0% and Xe in a mixture ratio of 6%~30%.

In the plasma display panel, the hydrogen group isotope gas includes: at least one hydrogen group isotope gas of $H_2$, $D_2$ and $T_2$.

In the plasma display panel, a mixture ratio of the Xe in relation to the discharge gas is between 6% and 14%.

In the plasma display panel, the gap between the scan electrode and the sustain electrode which are formed on the first substrate is between 80 μm and 500 μm.

A plasma display panel according to still another aspect of the present invention includes: a first substrate having at least one electrode; a second substrate having at least one electrode; and a discharge gas charged in a discharge space between the first and second substrates, and wherein the discharge gas includes a hydrogen group isotope gas in a mixture ratio of 0.01%~2.0%, and a dielectric layer of 30 μm to 100 μm in thickness is formed in the first substrate.

In the plasma display panel, the hydrogen group isotope gas includes: at least one hydrogen group isotope gas of $H_2$, $D_2$ and $T_2$.

In the plasma display panel, a mixture ratio of the Xe in relation to the discharge gas is between 6% and 30%.

In the plasma display panel, a mixture ratio of the Xe in relation to the discharge gas is between 6% and 14%.

In the plasma display panel, the gap between the scan electrode and the sustain electrode which are formed on the first substrate is between 80 μm and 500 μm.

A plasma display panel according to still another aspect of the present invention includes: a first substrate having at least one electrode; a second substrate having at least one electrode; and a discharge gas charged in a discharge space between the first and second substrates, and wherein the discharge gas includes a hydrogen group isotope gas in a mixture ratio of 0.01%~2.0% and Xe in a mixture ratio of 6%~30%, and a gap between the electrodes formed on the first substrate is between 80 μm and 500 μm.

In the plasma display panel, the electrodes separated with the gap between 80 μm and 500 μm are a scan electrode and a sustain electrode.

In the plasma display panel, the hydrogen group isotope gas includes: at least one hydrogen group isotope gas of $H_2$, $D_2$ and $T_2$.

In the plasma display panel, a mixture ratio of the Xe in relation to the discharge gas is between 6% and 14%.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 4 to 10.

Figure 1:
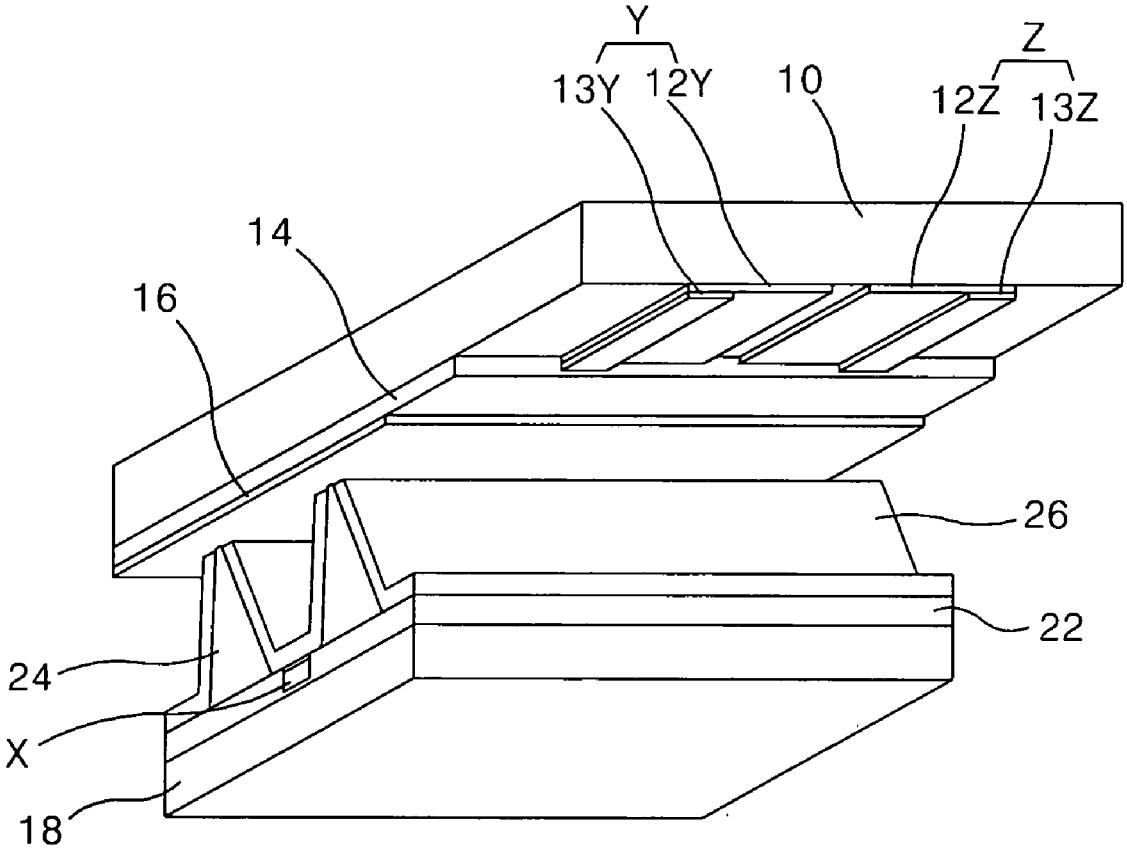
FIG. 1 RELATED ART
FIG. 1 is a perspective view representing a discharge cell structure of the related art PDP.
Figure 2:
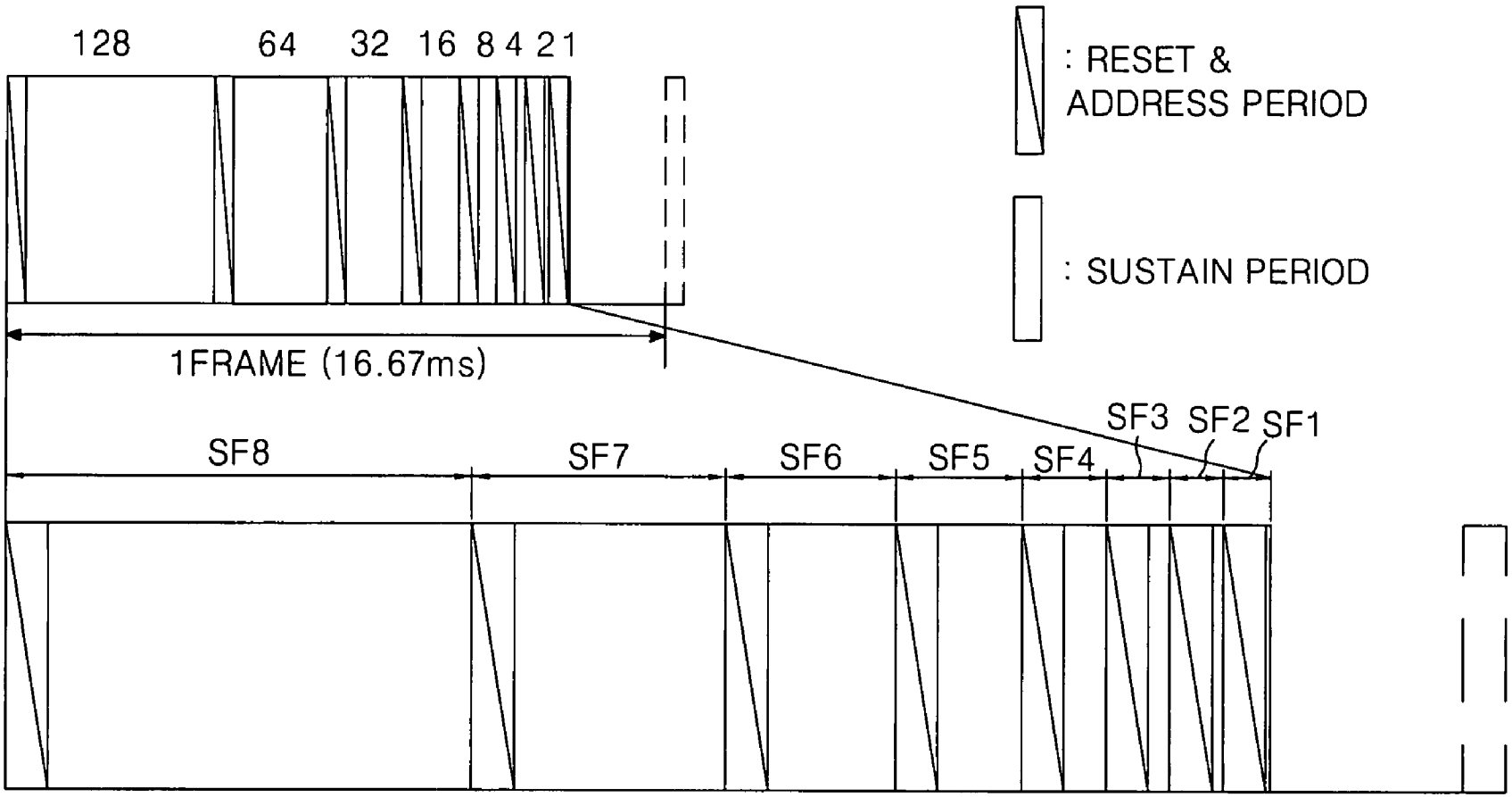
FIG. 2 RELATED ART
FIG. 2 is a diagram representing one frame of the related art PDP.
Figure 3:
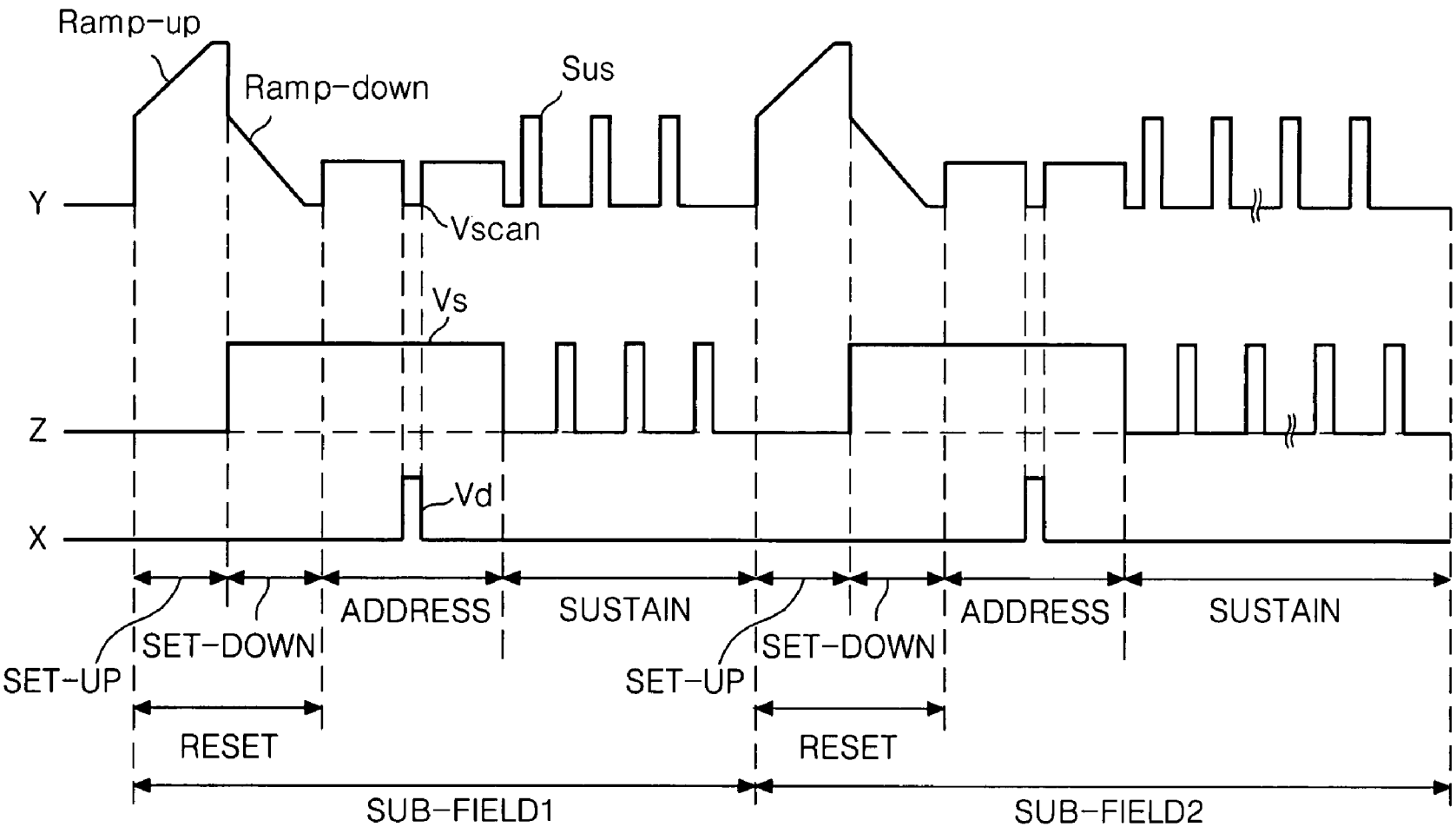
FIG. 3 RELATED ART
FIG. 3 is a waveform diagram representing a driving method of the related art PDP.
Figure 4:
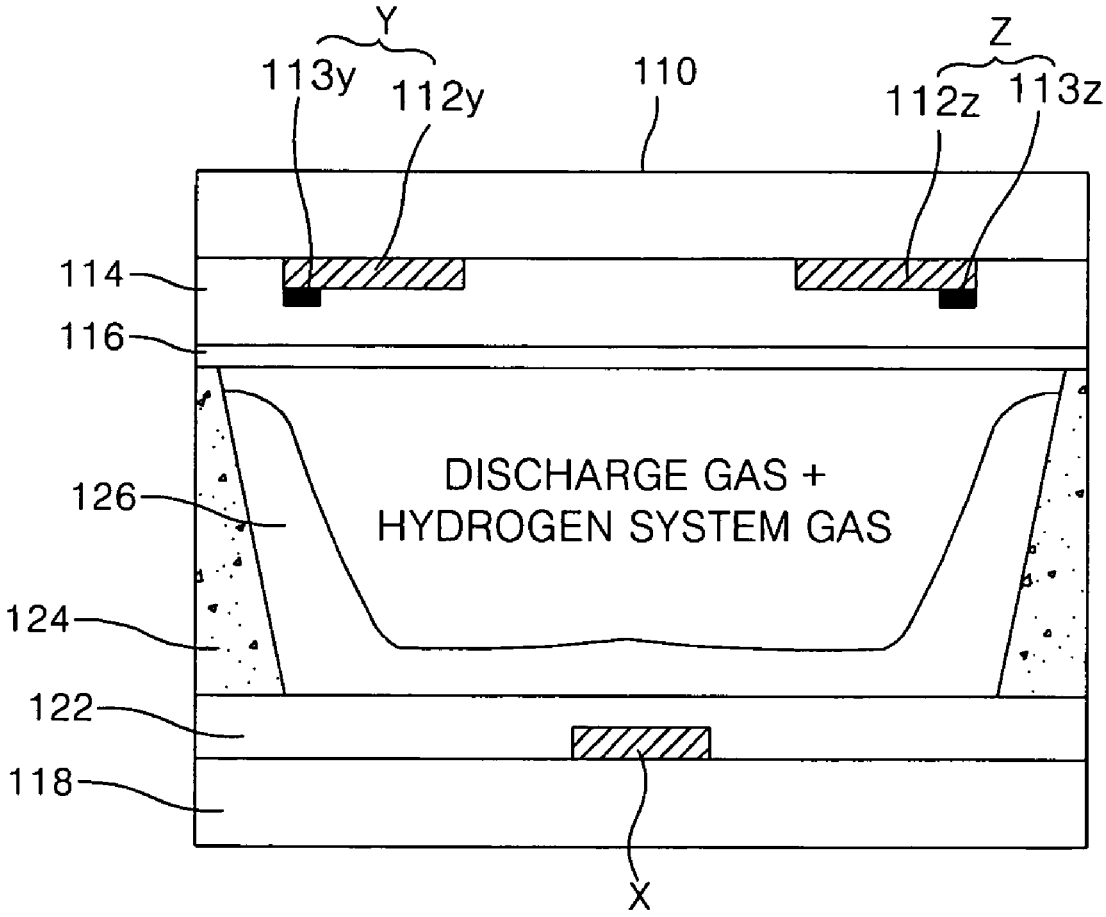
FIG. 4 is a sectional diagram representing a PDP according to an embodiment of the present invention.

FIG. 4 is a sectional diagram representing a discharge cell of a PDP according to an embodiment of the present invention. In FIG. 4, in order that the structure of all the electrodes is clearly shown, a lower substrate of the PDP rotates in relation to an upper substrate of the PDP by 90°.

Referring to FIG. 4, the PDP according to the embodiment of the present invention includes a scan electrode Y and a sustain electrode Z formed on an upper substrate 110, and an address electrode X formed on a lower substrate 118. Each of the scan electrode Y and the sustain electrode Z includes transparent electrodes 112Y, 112Z and metal bus electrodes 113Y, 113Z of which each has a narrower line width than the transparent electrode and is formed at one side edge of the transparent electrode.

The transparent electrodes 112Y, 112Z are formed of indium tin oxide ITO on the upper substrate 110 in the related art. The metal bus electrodes 113Y, 113Z are formed of a metal such as chrome Cr on the transparent electrodes 112Y, 112Z to act to reduce a voltage drop which is caused by the transparent electrodes 112Y, 112Z of high resistance. A dielectric layer 114 and a passivation film 116 are deposited on the upper substrate 110 where the scan electrode Y and the sustain electrode Z are formed in parallel. A wall charge generated upon a plasma discharge is accumulated in an upper dielectric layer 114. The passivation film 116 prevents the loss of the upper dielectric layer 114 from the sputtering caused by ions generated upon the plasma discharge and increases the emission efficiency of secondary electrons. The passivation film 116 is of magnesium oxide MgO in the related art.

The address electrode X is formed in a direction of crossing the scan electrode Y and the sustain electrode Z. A lower dielectric layer 122 and barrier ribs 124 are formed on the lower substrate 118 where the address electrode X is formed. A phosphorus layer 126 is formed on the surface of the lower dielectric layer 122 and the barrier ribs 124. The barrier ribs 124 is formed in a stripe or lattice (or closed type) shape to prevent the ultraviolet ray and the visible ray generated by the discharge from leaking into adjacent discharge cells. The phosphorus layer 126 is excited by the ultraviolet ray generated upon the plasma discharge to generate any one visible ray of red, green or blue. A discharge gas is injected into a discharge space provided between the upper/lower substrates 110, 118 and the barrier ribs 124.

The discharge gas includes Xe of about 6% or more (desirably 6%~30%) and its gas pressure is not higher than 700 torr (desirably 400 torr~600 torr) so that the discharge/luminescence efficiency and brightness of the PDP can be improved. If the mixture ratio of Xe is lower than 6% in the discharge gas, the discharge/luminescence efficiency excessively decrease. If the density of Xe is not less than 30%, the discharge voltage excessively increases, thus it is almost impossible to drive the PDP.

Further, the discharge gas includes at least one of $H_2$, $D_2$ and $T_2$, which are hydrogen group isotope gas. If the hydrogen group isotope gas is included in the discharge gas like this, the discharge firing voltage, at which the discharge starts, becomes low and the luminescence efficiency becomes high, thus the power consumption can be reduced and the efficiency can be increased.

Figure 5:
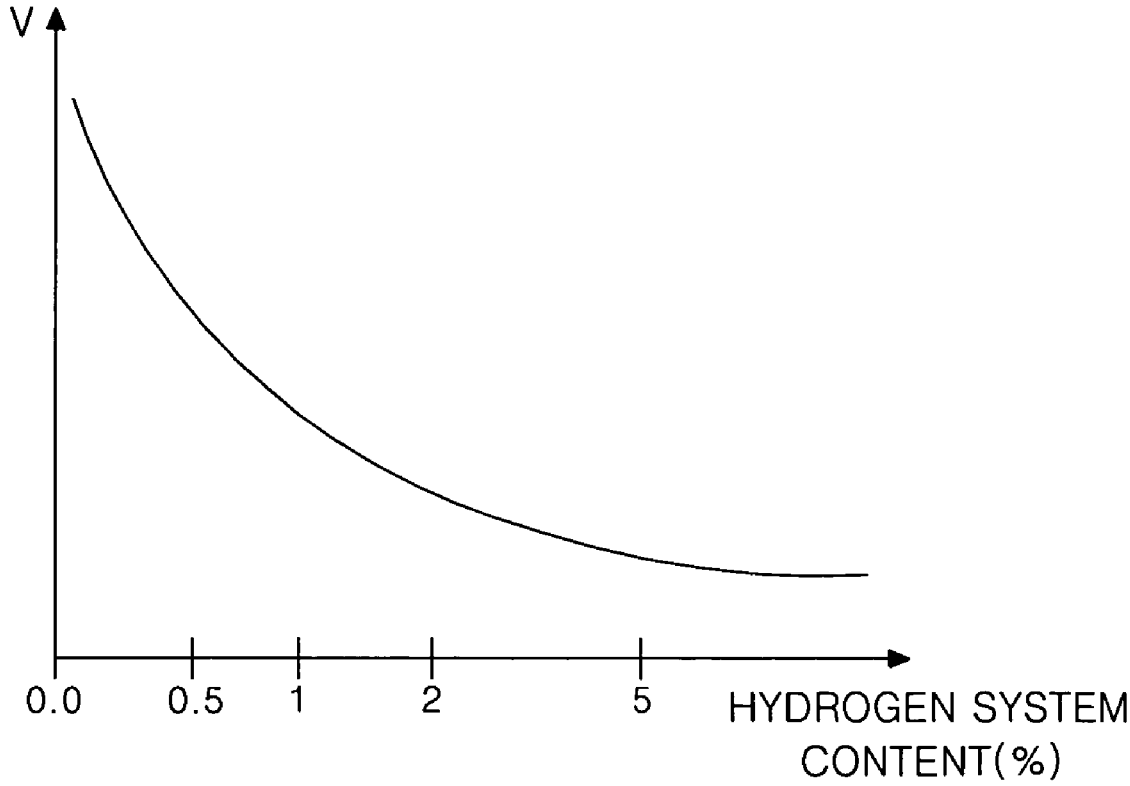
FIG. 5 is a graph representing a change of a discharge voltage in accordance with its content ratio when mixing a hydrogen group isotope gas into a discharge gas.

When the hydrogen group isotope gas is mixed into the discharge gas, a change of a discharge voltage in accordance with the content ratio is as in FIG. 5. In FIG. 5, the horizontal axis is the content ratio (%) of the hydrogen group isotope gas, and the vertical axis is the discharge voltage (V). As it can be known in FIG. 5, as the content ratio (%) of the hydrogen group isotope gas increases, the discharge voltage decreases exponentially. As it can be known in FIG. 5, the discharge voltage decreases rapidly when the mixture ratio (%) of the hydrogen group isotope gas is not more than 2%, but on the other hand, there is almost no change in the decrease of the discharge voltage when it is not less than 2%.

Figure 6:
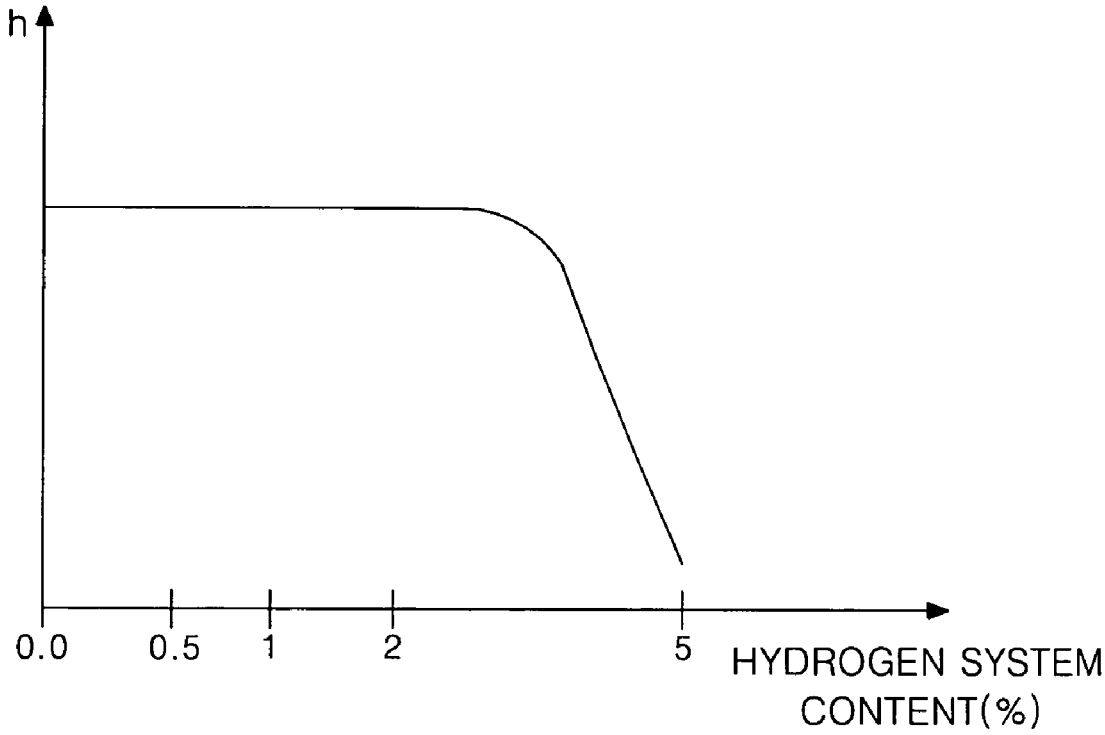
FIG. 6 is a graph representing a change of efficiency in accordance with its content ratio when mixing a hydrogen group isotope gas into a discharge gas.

When mixing the hydrogen group isotope gas into the discharge gas, a change of discharge/luminescence efficiency in accordance with the content ratio is as in FIG. 6. In FIG. 6, the horizontal axis is the content ratio (%) of the hydrogen group isotope gas, and the vertical axis is the efficiency (h). As it can be known in FIG. 6, the efficiency is shown to be almost the same where the mixture ratio (%) of the hydrogen group isotope gas is not more than 2% approximately, but on the other hand, it rapidly decreases from a point where it is not less than 2%.

The experiment of FIGS. 5 and 6 is performed for the sample of the PDP that the gap between the scan electrode Y and the sustain electrode Z is 60 μm, the content ratio of Xe to the discharge gas is 8% and the pressure of the discharge gas is 500 torr.

On the basis of the experiment result of FIGS. 5 and 6, in order that the hydrogen group isotope gas mixed into the discharge gas lowers the discharge voltage and the deterioration of the efficiency is reduced, it should be around 0.01%~2.0% that is lower than the Xe content ratio.

Figure 7:
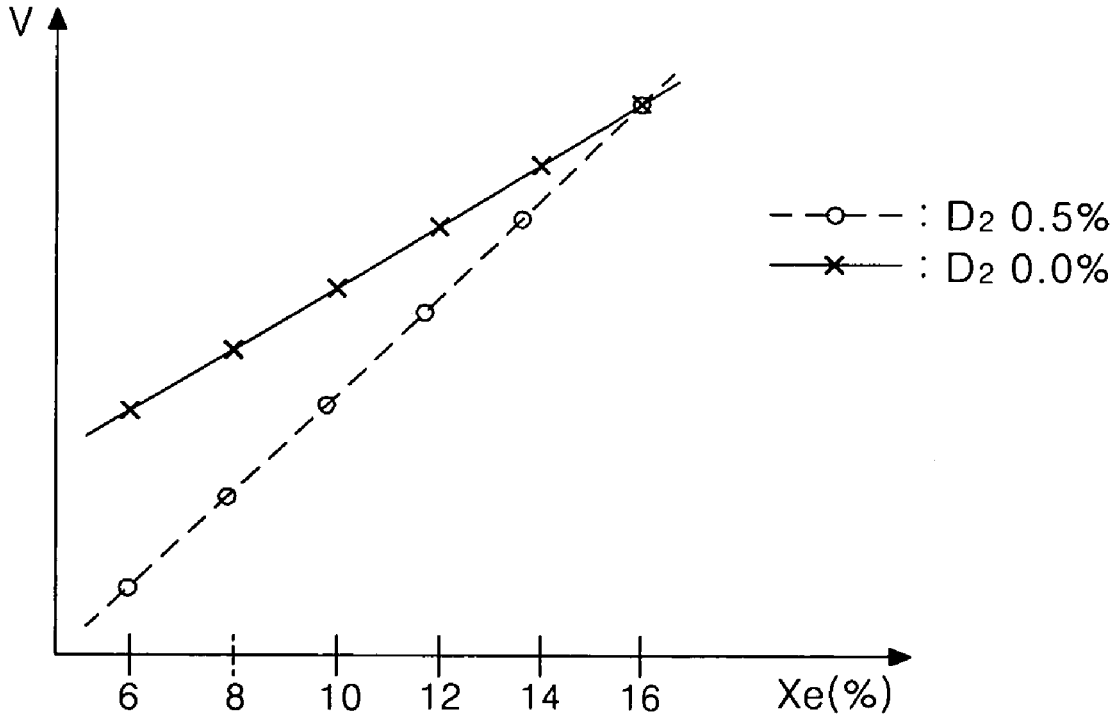
FIG. 7 is a graph representing a change of a discharge voltage in accordance with an Xe content ratio.
Figure 8:
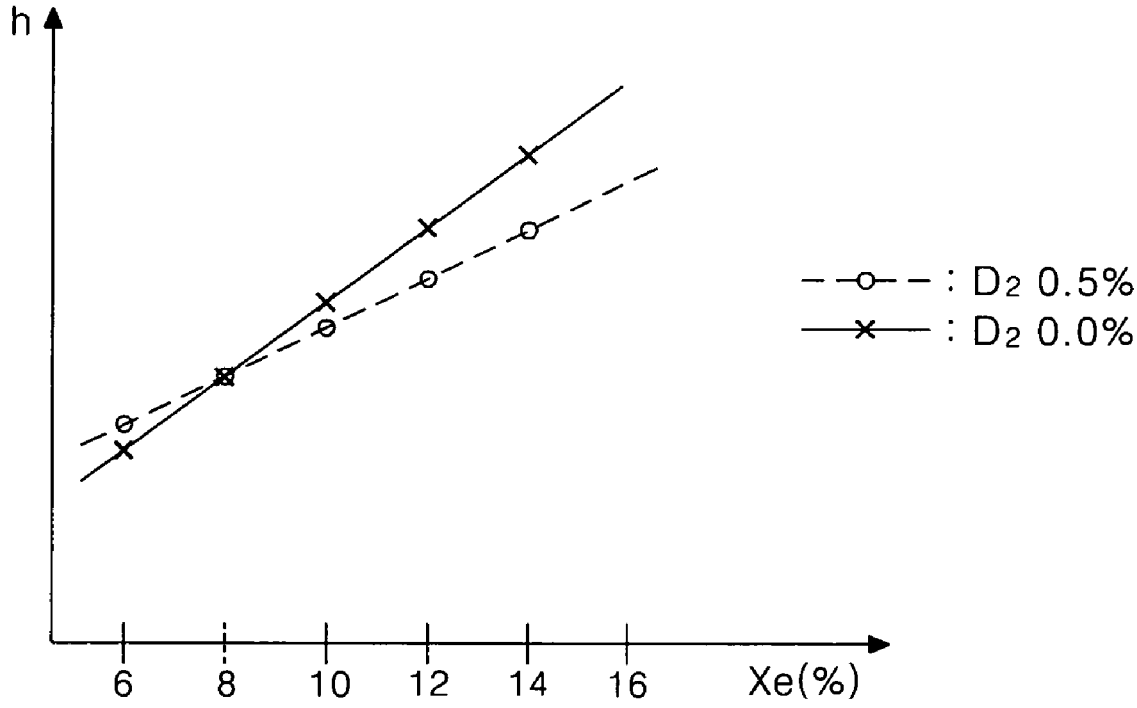
FIG. 8 is a graph representing a change of efficiency in accordance with an Xe content ratio.

FIGS. 7 and 8 represent a change of efficiency (h) and a discharge voltage (V) in accordance with an Xe content ratio. FIGS. 7 and 8 are an experiment result where the discharge voltage (V) and the efficiency (h) are measured as the Xe content ratio (%) is increased to 14% for the sample of the PDP that the gap between the scan electrode Y and the sustain electrode Z is 60 μm, the pressure of the discharge gas is 500 torr and $D_2$ is added by 0.5% to the discharge gas. In FIGS. 7 and 8, the horizontal axis is the content ratio (%) of Xe, and the vertical axis is the discharge voltage (V) and the efficiency (h). As it can be known in FIGS. 7 and 8, the discharge voltage and the efficiency are optimized when the Xe content ratio (%) is 6%~14%, in the PDP where the hydrogen group isotope gas is added to the discharge gas. As it can be known in FIG. 7, the discharge voltage reduction effect decreases at the vicinity of the point where the mixture ratio of Xe is 16%.

When the hydrogen group isotope gas is mixed into the discharge gas like this, the discharge voltage can be reduced, thus the effect becomes bigger when it is applied to the long gap PDP that the gap between the scan electrode Y and the sustain electrode Z is made to be not less than 80 μm to increase the efficiency. That is, as the gap between the scan electrode Y and the sustain electrode Z becomes bigger, the efficiency increases but there is a disadvantage that the discharge voltage increases. The present invention can reduce the discharge voltage while increasing the efficiency by mixing the hydrogen group isotope gas into the discharge gas in the long gap PDP. The long gap PDP applied to the present invention is that the gap between the scan electrode Y and the sustain electrode Z is not less than 80 μm (desirably 80 μm~500 μm). If the gap between the scan electrode Y and the sustain electrode Z exceed about 500 μm, the size of cell is too big to be used as a display device, thus it is impossible to manufacture the PDP, and a surface discharge is not generated first between the scan electrode Y and the sustain electrode Z upon discharge as it supposed to be, but the surface discharge is generated after the opposite discharge between any one of the electrodes Y and the address electrode X of the lower plate, thus it becomes in reverse order to the discharge mechanism where the PDP is stably driven, thereby making it impossible to be driven. In the long gap PDP applied to the present invention, the gap between the scan electrode Y and the sustain electrode Z is not less than 80 μm (specifically 80 μm~500 μm). Further, in the long gap PDP applied to the present invention, the gap between the scan electrode Y and the sustain electrode Z is desirably 100 μm~200 μm.

Figure 9:
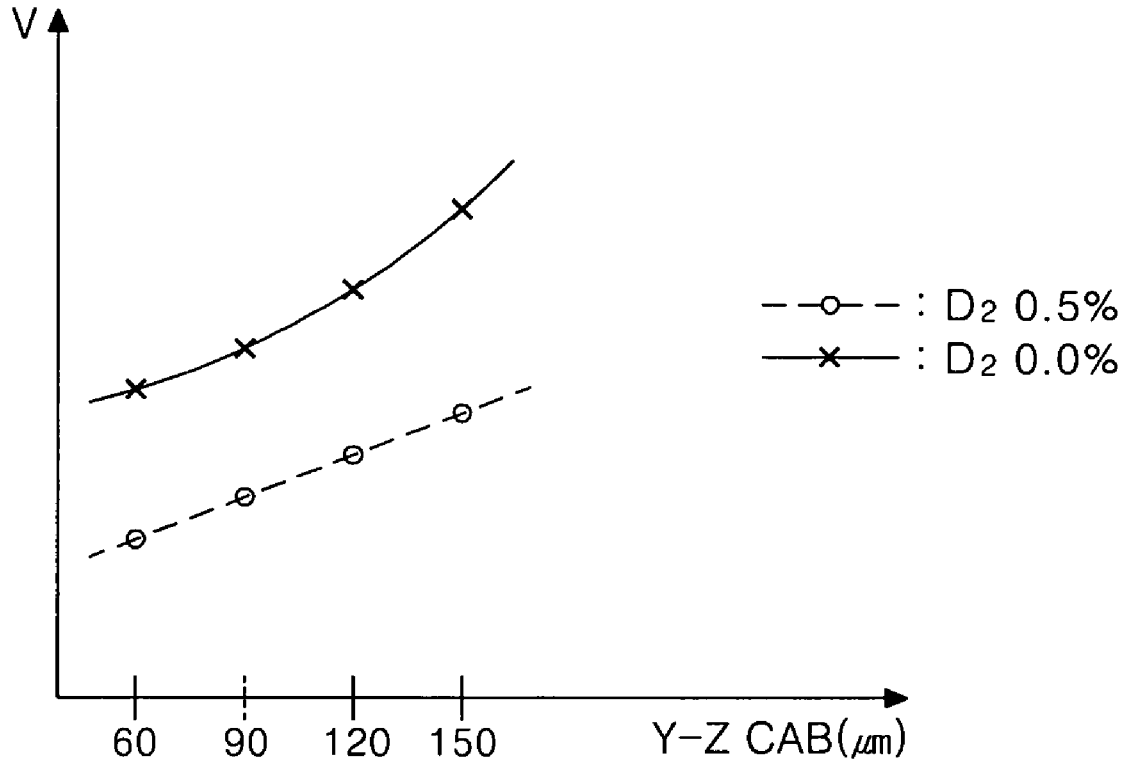
FIG. 9 is a graph representing a change of a discharge voltage in accordance with a gap between a scan electrode and a sustain electrode.
Figure 10:
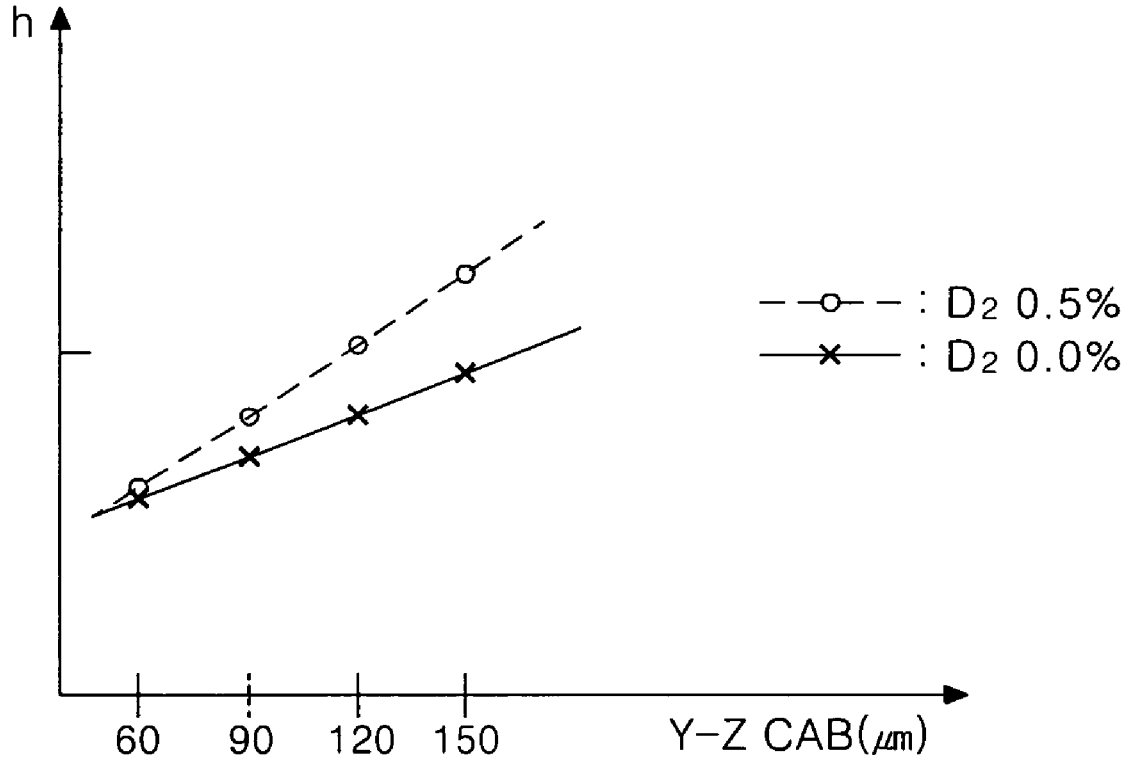
FIG. 10 is a graph representing a change of efficiency in accordance with a gap between a scan electrode and a sustain electrode.

FIGS. 9 and 10 represent a change of efficiency (h) and a discharge voltage (V) in accordance with a gap between the scan electrode Y and the sustain electrode Z. FIGS. 9 and 10 are an experiment result where the discharge voltage (V) and the efficiency (h) are measured as the gap (μm) between the scan electrode Y and the sustain electrode Z is increased to 150 μm for the sample of the PDP that the pressure of the discharge gas is 500 torr, the Xe content ratio is 8% and $D_2$ is added by 0.5% to the discharge gas. In FIGS. 9 and 10, the horizontal axis is the gap (μm) between the scan electrode Y and the sustain electrode Z, and the vertical axis is the discharge voltage (V) and the efficiency (h). As it can be known in FIGS. 9 and 10, the discharge voltage and the efficiency are optimized when the gap (μm) between the scan electrode Y and the sustain electrode Z is 60 μm~80 μm, in the PDP where the hydrogen group isotope gas is added to the discharge gas.

Further, the PDP according to the present invention adds the hydrogen group isotope gas of not more than 2.0% to the discharge gas and makes the thickness of the upper dielectric layer 114 not less than 30 μm (desirably 30 μm~100 μm) to further reduce the power consumption. This is because the discharge firing voltage is lowered and the efficiency increases by the hydrogen group isotope gas, and the displacement current and the reactive power of the upper plate is reduced as the upper dielectric layer 114 becomes thicker. On the other hand, if the thickness of the dielectric layer 114 exceeds 100 μm, the light loss becomes bigger in the dielectric layer, thus the brightness is excessively decreased.

This invention can be applied to the gas discharge tube as well as to the gas discharge tube and the PDP.

As described above, the gas discharge tube and the PDP according to the present invention can reduce the discharge firing voltage by mixing the hydrogen group isotope gas into the discharge gas. Further, the PDP according to the present invention mixes the hydrogen group isotope gas into the discharge gas which is injected into the long gap PDP that the gap between the scan electrode and the sustain electrode is wide, thereby enabling to reduce the discharge voltage and to increase the efficiency. Further, the PDP according to the present invention mixes the hydrogen group isotope gas into the discharge gas and has the upper dielectric layer thicker, thereby enabling to reduce the power consumption remarkably.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A gas discharge apparatus where an electrode and a phosphorus layer are formed, a discharge space in which a gas medium is sealed is formed, an ultraviolet ray is generated upon discharge, the ultraviolet ray is converted into a visible ray in the phosphorus layer to emit light, wherein a discharge gas injected into the discharge space includes a hydrogen group isotope gas in a mixture ratio of 0.01%~2.0% and the discharge gas has a gas pressure in the range of 400-900 torr, wherein the hydrogen group isotope is selected from the group consisting of $D_2$ and $T_2$.

2. The gas discharge apparatus according to claim 1, wherein the discharge gas includes at least two hydrogen group isotopes, wherein the second hydrogen group isotope is selected from the group consisting of $H_2$, $D_2$ and $T_2$.

3. A gas discharge apparatus where an electrode and a phosphorus layer are formed, a discharge space in which a gas medium is sealed is formed, an ultraviolet ray is generated upon discharge, the ultraviolet ray is converted into a visible ray in the phosphorus layer to emit light, wherein a discharge gas injected into the discharge space includes at least one hydrogen group isotope gas of $T_2$ and has a gas pressure in the range of 400-900 torr.

4. The gas discharge apparatus according to claim 3, wherein the hydrogen group isotope gas is included in the discharge gas in a mixture ratio of 0.01%~2.0%.

5. A plasma display panel, comprising:

a first substrate having at least one electrode;

a second substrate having at least one electrode; and a discharge gas charged in a discharge space between the first and second substrates, and wherein the discharge gas includes a hydrogen group isotope gas in a mixture ratio of 0.01%~2.0% and the discharge gas has a gas pressure in the range of 400-900 torr, wherein the hydrogen group isotope is selected from the group consisting of $D_2$ and $T_2$.

6. The plasma display panel according to claim 5, wherein the hydrogen group isotope gas is included in the discharge gas in a mixture ratio of 0.01%~2.0%.

7. A plasma display panel, comprising:

a first substrate having at least one electrode;

a second substrate having at least one electrode; and a discharge gas charged in a discharge space between the first and second substrates, and wherein the discharge gas includes at least one hydrogen group isotope gas of $T_2$ and has a gas pressure in the range of 400-900 torr.

8. A plasma display panel, comprising:

a first substrate having at least one electrode;

a second substrate having at least one electrode; and a discharge gas charged in a discharge space between the first and second substrates, and wherein the discharge gas includes a hydrogen group isotope gas in a mixture ratio of 0.01%~2.0%, and a gap between the electrodes formed on the first substrate is between 80 μm and 500 μm.

9. The plasma display panel according to claim 8, wherein the electrodes separated with the gap between 80 μm and 500 μm are a scan electrode and a sustain electrode.

10. The plasma display panel according to claim 8, wherein the hydrogen group isotope gas includes:

at least one hydrogen group isotope gas of $H_2$, $D_2$ and $T_2$.

11. The plasma display panel according to claim 9, wherein the gap between the scan electrode and the sustain electrode is between 100 μm and 200 μm.

12. A plasma display panel, comprising:

a first substrate having at least one electrode;

a second substrate having at least one electrode; and a discharge gas charged in a discharge space between the first and second substrates, and wherein the discharge gas includes a hydrogen group isotope gas in a mixture ratio of 0.01%~2.0% and Xe in a mixture ratio of 6%~30%.

13. The plasma display panel according to claim 12, wherein the hydrogen group isotope gas includes:

at least one hydrogen group isotope gas of $H_2$, $D_2$ and $T_2$.

14. The plasma display panel according to claim 12, wherein a mixture ratio of the Xe in relation to the discharge gas is between 6% and 14%.

15. The plasma display panel according to claim 12, wherein the gap between the scan electrode and the sustain electrode which are formed on the first substrate is between 80 μm and 500 μm.

16. A plasma display panel, comprising:

a first substrate having at least one electrode;

a second substrate having at least one electrode; and a discharge gas charged in a discharge space between the first and second substrates, and wherein the discharge gas includes a hydrogen group isotope gas in a mixture ratio of 0.01%~2.0%, and a dielectric layer of 30 μm to 100 μm in thickness is formed in the first substrate.

17. The plasma display panel according to claim 16, wherein the hydrogen group isotope gas includes:

at least one hydrogen group isotope gas of $H_2$, $D_2$ and $T_2$.

18. The plasma display panel according to claim 16, wherein a mixture ratio of the Xe in relation to the discharge gas is between 6% and 30% .

19. The plasma display panel according to claim 18, wherein a mixture ratio of the Xe in relation to the discharge gas is between 6% and 14% .

20. The plasma display panel according to claim 16, wherein the gap between the scan electrode and the sustain electrode which are formed on the first substrate is between 80 μm and 500 μm.

21. A plasma display panel, comprising:

a first substrate having at least one electrode;

a second substrate having at least one electrode; and a discharge gas charged in a discharge space between the first and second substrates, and wherein the discharge gas includes a hydrogen group isotope gas in a mixture ratio of 0.01%~2.0% and Xe in a mixture ratio of 6%~30%, and a gap between the electrodes formed on the first substrate is between 80 μm and 500 μm.

22. The plasma display panel according to claim 21, wherein the electrodes separated with the gap between 80 μm and 500 μm are a scan electrode and a sustain electrode.

23. The plasma display panel according to claim 21, wherein the hydrogen group isotope gas includes:

at least one hydrogen group isotope gas of $H_2$, $D_2$ and $T_2$.

24. The plasma display panel according to claim 21, wherein a mixture ratio of the Xe in relation to the discharge gas is between 6% and 14%.

* * * * *